US007891147B2

(12) United States Patent
Bruder

(10) Patent No.: US 7,891,147 B2
(45) Date of Patent: Feb. 22, 2011

(54) PROFILE FOR A LIGHT WALL AND LIGHT WALL PROFILE SYSTEM

(75) Inventor: Hans Bruder, Aichtal (DE)

(73) Assignee: Octanorm-Vertriebs-GmbH fuer Bauelemente, Filderstadt (DE)

( * ) Notice: Subject to any disclaimer, the term of this patent is extended or adjusted under 35 U.S.C. 154(b) by 955 days.

(21) Appl. No.: 11/689,815

(22) Filed: Mar. 22, 2007

(65) Prior Publication Data

US 2007/0234659 A1 Oct. 11, 2007

(30) Foreign Application Priority Data

Mar. 22, 2006 (DE) ..... 20 2006 005 039

(51) Int. Cl.
*E06B 1/00* (2006.01)

(52) U.S. Cl. ..... 52/210; 52/211; 52/204.5; 52/204.55

(58) Field of Classification Search ..... 52/204.1, 52/210–213, 204.5, 204.54, 204.55, 204.56, 52/204.595, 204.6, 204.68, 204.7, 204.71, 52/204.72, 506.06, 506.08
See application file for complete search history.

(56) References Cited

U.S. PATENT DOCUMENTS

| | | | | |
|---|---|---|---|---|
| 3,173,179 | A * | 3/1965 | Edwards | 52/206 |
| 3,327,438 | A * | 6/1967 | Cooper | 52/205 |
| 3,715,776 | A * | 2/1973 | Tanaka | 16/94 D |
| 3,848,387 | A * | 11/1974 | Hafner | 52/213 |
| 3,932,974 | A * | 1/1976 | Wright | 52/235 |
| 2007/0251428 | A1 * | 11/2007 | Mead et al. | 108/50.02 |

FOREIGN PATENT DOCUMENTS

| | | | |
|---|---|---|---|
| DE | 28 17 877 | A1 | 10/1979 |
| DE | 38 14734 | A1 | 11/1989 |
| DE | 299 00 957 | U1 | 5/1999 |
| DE | 202 16 231 | U1 | 4/2004 |
| DE | 102 49 807 | A1 | 5/2004 |
| DE | 20 2005 005 616 | U1 | 8/2005 |
| EP | 0 522 854 | B1 | 4/1997 |
| EP | 1 021 973 | A2 | 7/2000 |
| GB | 1 277 292 | | 6/1972 |

OTHER PUBLICATIONS

Corresponding German Search Report dated Dec. 13, 2006 with English translation of relevant portion (Nine (9) pages).
Greek Search Report dated Mar. 11, 2008 (One (1) page).
Mexican Examination Report dated Jul. 20, 2010(Five (5) pages).

* cited by examiner

*Primary Examiner*—Jeanette E. Chapman
(74) *Attorney, Agent, or Firm*—Crowell & Moring LLP

(57) ABSTRACT

A profile for a light wall includes at least one first, essentially closed hollow chamber, into which a connector can be inserted on at least one end side of the profile, and at least one second hollow chamber having a system groove running essentially parallel to the longitudinal axis on a lateral outer face, into which a holder for a wall element, which can be arranged essentially parallel to the lateral outer face, can be inserted. The profile includes at least one third hollow chamber with at least one cable groove, which runs essentially parallel to the longitudinal axis and emerges from a cover face and/or a bottom face. The profile and profile system may be used, for example, for trade fairs and exhibitions.

20 Claims, 10 Drawing Sheets

Fig. 16
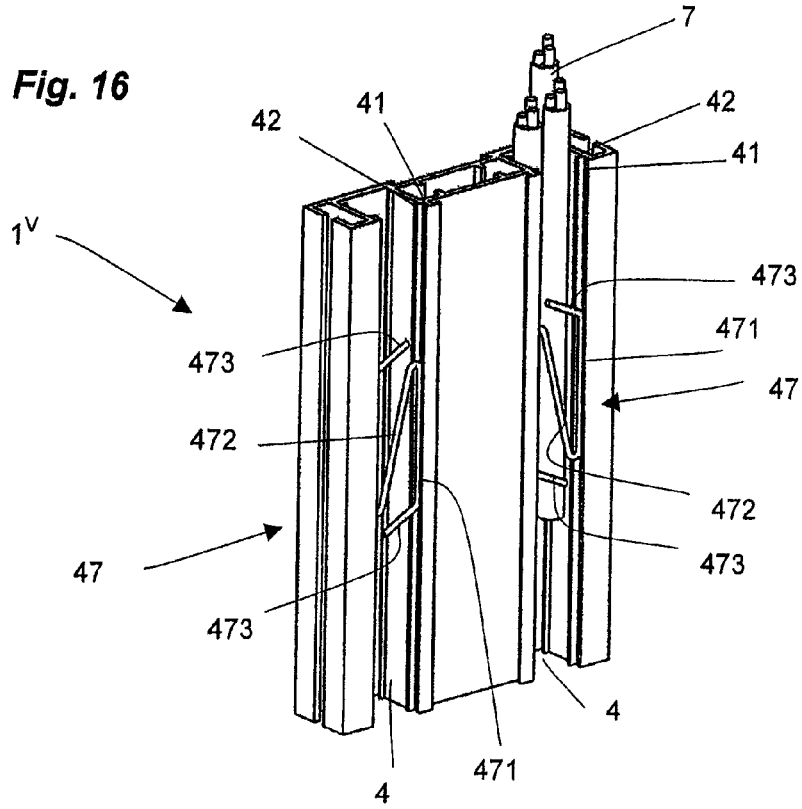
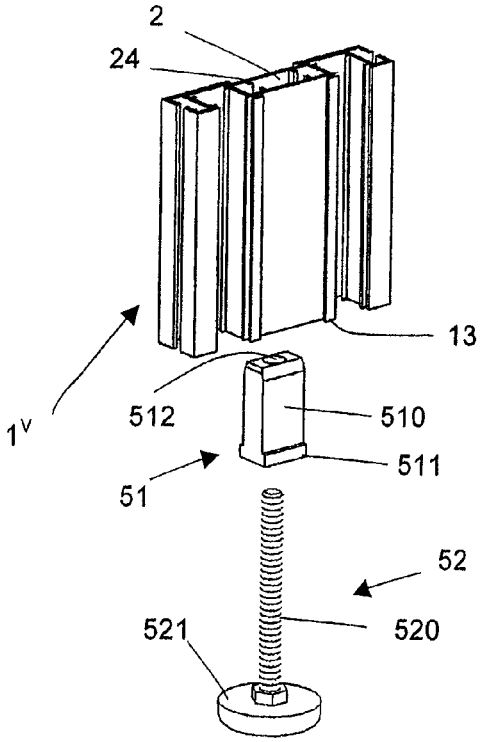
Fig. 17
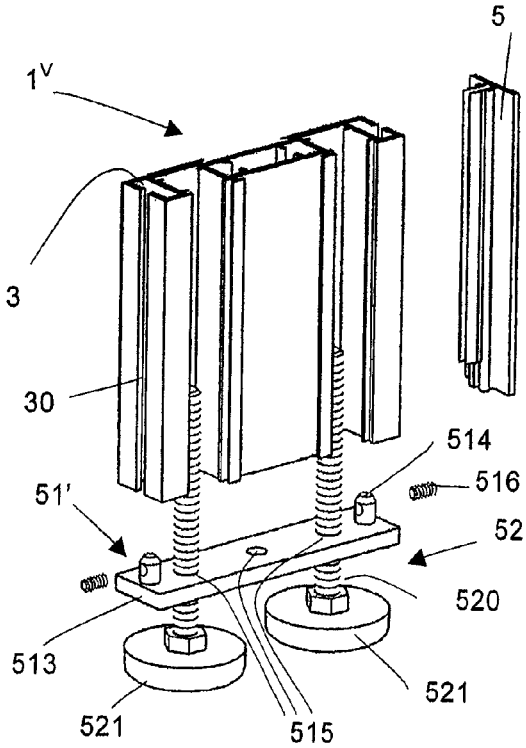
Fig. 18

PROFILE FOR A LIGHT WALL AND LIGHT WALL PROFILE SYSTEM

BACKGROUND AND SUMMARY OF THE INVENTION

This application claims the priority of German Application No. 20 2006 005 039.6, filed Mar. 22, 2006, the disclosure of which is expressly incorporated by reference herein.

The invention relates to a profile for a light wall, including at least one first, essentially closed hollow chamber, into which a connector can be inserted on at least one end side of the profile, and at least one second hollow chamber having a system groove running essentially parallel to the longitudinal axis on a lateral outer face, into which a holder for a wall element, which can be arranged essentially parallel to the outer face, can be inserted. The invention also relates to light wall profile systems for constructing a light wall comprising at least two profiles which can be connected.

Profile systems for rapidly constructing stands, walls, or the like, for example for trade fairs and/or exhibitions, are generally known. The profile systems include, for example, vertically running supports, which have system grooves running parallel to their longitudinal axis on their side faces. Horizontally running frames are arranged at certain distances from one another on the supports. The frames have a hollow chamber, into which a connector, for example a turnbuckle, can be inserted on the end sides of the profile. The turnbuckle engages in the system groove formed on the supports, and the frame can be connected to the support by the turnbuckle being tightened. In addition, frames and/or supports can be coupled via miter brackets or straight connectors.

In order to construct a wall it is known to form system grooves on the outer faces of the frame, into which grooves a holder for a plate, for example a plexiglass plate or a glass plate, can be inserted. As a result, a wall can be constructed by inserting plates on a trellis constructed from frames and supports.

The object of the present invention is to provide a profile for a light wall which makes it possible to construct a light wall quickly and simply and also to provide an associated light wall profile system.

The object is achieved by a profile for a light wall, including at least one first, essentially closed hollow chamber, into which a connector can be inserted on at least one end side of the profile, at least one second hollow chamber having a system groove running essentially parallel to the longitudinal axis on a lateral outer face, into which a holder for a wall element, which can be arranged essentially parallel to the outer face, can be inserted, and at least one third hollow chamber with at least one cable groove, which runs essentially parallel to the longitudinal axis and emerges from a cover face and/or a bottom face.

Cables can be arranged, hidden, such that they run parallel to the longitudinal axis of the profile in the cable groove formed on the cover face and/or on the bottom face. In this case, the cable groove is advantageously designed such that it extends essentially over the entire height of the profile. As a result, a very large number of cables or thick cables can be arranged hidden in the cable groove and, as a result, the profile does not need to be designed to be substantially higher than the cable groove. As a result, esthetically superior light walls can be constructed in which the posts and frames are designed to be very narrow. The wall element is, for example, a transparent glass plate or plastic plate.

Preferably, the third hollow chamber with the cable groove or cable grooves is arranged between the second hollow chamber and the first hollow chamber. It is contemplated to form a hollow chamber with a cable groove only on one side of the closed hollow chamber and to provide both lateral outer faces of the profile with hollow chambers with system grooves. In this manner, cables can be guided such that they are protected in the cable groove and such that they are spaced apart from an outer face of the light wall by the second hollow chamber. When a light wall is constructed and dismantled, the cables are thereby easily accessible.

In accordance with an advantageous development of the invention, the profile is symmetrical. As a result, plates can be arranged and cables laid on both lateral outer faces of the profile. In accordance with one embodiment, the profile is axially symmetrical with respect to a transverse axis running through the mid-point of the profile parallel to the system grooves. Such a profile has a system groove, for example, on both lateral outer faces, but the cable grooves of the third hollow chambers are open on one side of the profile towards the cover face and on the second side of the profile towards the bottom face.

In one development of the invention, the first hollow chamber is rectangular, edges of the hollow chamber which run parallel to the cover face and the bottom face being longer than edges running parallel to the outer faces. The hollow chamber should be large enough to safely accommodate a connector, for example a turnbuckle. Owing to the rectangular embodiment of the hollow chamber, the size required for this essentially only has an effect on one dimension of the thus constructed profile wall, with the result that a low height of the profile can be achieved. The depth of the profile may be large, however, also in order to increase the stability of a light wall constructed by use of a corresponding profile.

In one development of the invention, in the region of the first hollow chamber, at least one cutout, which extends in particular transversely with respect to the longitudinal axis of the profile, is incorporated into the cover face and/or the bottom face. A connector, for example a turnbuckle, which is arranged in an end side of a second profile, can engage in the groove for the purpose of connecting the two profiles. By use of the groove, the profile can therefore be connected at right angles to other profiles according to the invention.

In one development of the invention, a turnbuckle, a foot or a miter bracket is inserted into the first hollow chamber on at least one end side of the profile.

Depending on the choice of element used, the profile can be used as a terminating part or as a connection part, as a frame or as a support. Different walls can therefore be constructed quickly and simply using identical profiles.

Preferably, the cover face and/or the bottom face of the first hollow chamber has at least one undercut, to which a luminaire can be fixed. The luminaire is, for example, in the form of a striplight. Expediently, two opposite undercuts are provided, with the result that a broad and flat groove with undercuts on both sides is produced, in which luminaires can be anchored or latched.

In one development of the invention, the cable groove has at least one projection, preferably two spaced-apart and groove-forming projections, on both sides at the top, i.e. in the region of the transition with the cover face, for the purpose of fixing cable-holding clamps, cable clips, cable fixings or covering strips.

In one development of the invention, the cable groove has at least one projection on both sides at the bottom, i.e. in the region of the transition to an essentially closed bottom face. For example, miter brackets for a connection between two profiles over a corner can be inserted between such projections and the bottom face.

In one development of the invention, at least one third hollow chamber has a web dividing it, with the result that in each case one cable groove opens in the region of the third hollow chamber both towards the cover face and towards the bottom face. As a result, cables or other elements can be inserted into the hollow chambers from both sides.

In one development of the invention, the cover face and the bottom face form an angle. The profile is particularly suitable, owing to the angled formation, for round walls or the like.

In one development of the invention, two hollow chambers with outer faces, which are arranged at an angle with respect to one another, each having an outer system groove, which runs essentially parallel to the longitudinal axis, are arranged on the broader outer side of a profile, forming an angle.

The object is further achieved by a light wall profile system comprising at least two profiles according to the invention, which can be arranged in relation to one another as a support and frame and can be coupled by means of a connector, right-hand and left-hand lateral outer faces of the support and the frame lying in one plane.

The profiles of the profile system can each be used both as a frame and as a support. Preferably, the profiles are essentially at right angles to one another. However, embodiments are also conceivable in which the profiles are arranged at an angle with respect to one another by means of a suitable connector. As the connector, for example, a turnbuckle can be inserted into the hollow chamber of a profile, which turnbuckle engages in a cutout incorporated in the cover face of the second profile. In another embodiment, the profiles are coupled via miter brackets. Since the lateral outer faces of the profiles lie in one plane, a plate or another wall element can be fixed easily. The hollow chambers of the cable grooves preferably likewise lie in one plane and open at least in sections in the direction of a clamped face, with the result that it is possible for cables for luminaires of a light wall to be laid easily and continuously, at least in sections. Advantageously, the respective outer supports are arranged such that the cover faces towards which the cable grooves now open are directed inwards. Alternatively, the cable grooves may be directed outwards and be closed by a cover strip. When using a transparent cover strip, even so-called light tubes or the like can be inserted into the cable grooves in order to illuminate even the narrow sides of the light wall.

In one development of the invention, a first profile has at least one cutout, which preferably runs transversely with respect to the longitudinal axis, in the cover and/or bottom face, and a connector can be inserted into at least one end face of a second profile, with the result that the second profile can be fixed in the cutout of the first profile by means of the connector. In this case, the first profile can be arranged as a support or as a frame. The first profile may have a large number of cutouts, a distance between the cutouts advantageously being selected such that square plates can be coupled, via the respective system grooves, in the faces clamped by the first and second profiles.

The invention is achieved further by a light wall profile system, two profiles, which are arranged parallel with respect to their longitudinal axis, being capable of being connected by way of at least one essentially wedge-shaped coupling element in such a way that the transverse axes, which are parallel to the cover faces, of the profiles form an angle of between 0° and 90°. Owing to the light wall profile system according to the invention, it is thus also possible to construct light walls having a round shape.

Further features and advantages of the invention result from the dependent claims and the description below of exemplary embodiments of the invention, which are illustrated in the drawings. Individual features of the various exemplary embodiments can in this case be combined with one another as desired without going beyond the scope of the invention. In this case, uniform reference symbols are used for the same components.

BRIEF DESCRIPTION OF THE DRAWINGS

FIG. 16 shows a perspective illustration of a profile with alternative cable fixings inserted;

FIG. 17 shows a perspective, exploded illustration of a profile, a foot receptacle and a foot;

FIG. 18 shows a perspective, exploded illustration of a profile, an alternative foot receptacle and a foot.

DETAILED DESCRIPTION OF THE DRAWINGS

Figure 1:
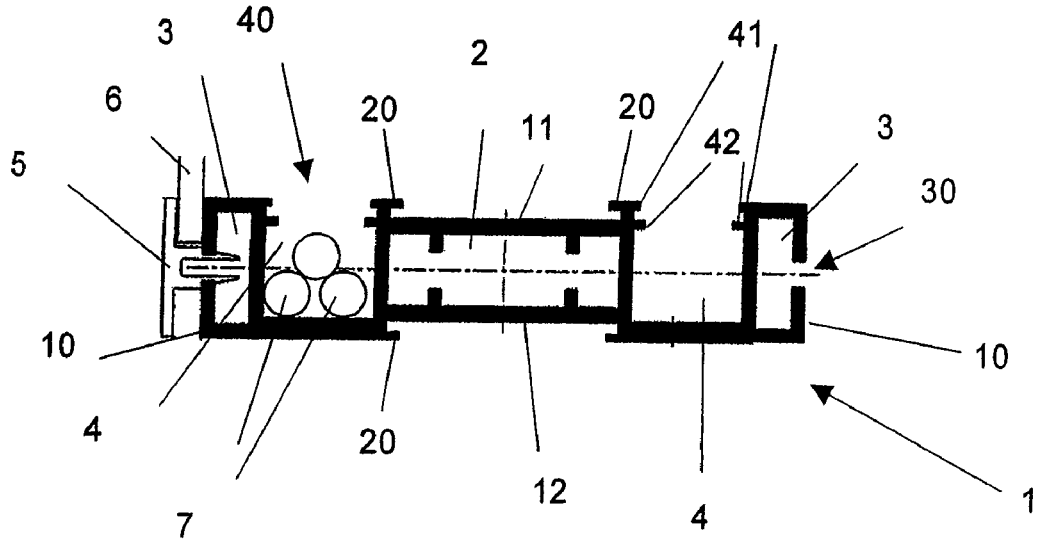
FIG. 1 shows a schematic sectional view of a profile according to the invention.

FIG. 1 shows, schematically, a profile 1 for a light wall. The profile 1 includes a first, central hollow chamber 2, two outer hollow chambers 3, which each have a system groove 30, which runs parallel to the longitudinal axis of the profile 1, on an associated lateral outer face 10 of the profile. T-shaped (in cross section) strips 5 can be inserted into the system grooves 30 for the purpose of fixing plates 6 or other wall elements. Instead of the strips 5, other holders for fixing wall elements, for example hooks or the like, can also be inserted into the system groove. The strips 5 are preferably clipped in and/or pushed on from an end face of the profile 1 without the use of a tool. The T-shaped strips 5 have, for this purpose, a U-shaped protrusion, on whose two limbs in each case one outwardly pointing latching hook is provided, which engages behind the system groove 30 in the latched-in state. Owing to the arrangement on the limbs of the U-shaped protrusion, the latching hooks are fixed in a sprung manner.

Hollow chambers 4, which each have a cable groove 40 on a cover face 11 of the profile, are arranged between the central hollow chamber 2 and the outer hollow chambers 3. The region is in this case referred to as a hollow chamber, even if, as illustrated, the cable groove 40 extends over the entire width and the hollow chamber is only formed by three walls. Cables 7, illustrated schematically, can be inserted into the hollow chambers 4 through the cable groove 40. In the embodiment illustrated, three cables 7 are laid in the left-hand hollow chamber 4. In other embodiments, more or fewer cables can be laid in the hollow chamber 4.

In the embodiment illustrated, the profile 1 is mirror-symmetrical with respect to a central plane running parallel to the outer faces 10. In another embodiment, the cross-sectional shape of the profile may be point-symmetrical with respect to a central point, in this case one of the two hollow chambers 4 having a cable groove opening towards the cover face 11, and the second hollow chamber 4 having a cable groove opening towards the bottom face 12.

The hollow chambers 4 each have projections 41, 42 in the upper region of the cable groove 40. In the embodiment illustrated, in each case two projections are formed on both sides of the cable groove 40. For example, a covering strip 43 (illustrated in FIG. 2) can be inserted between the projections 41, 42, which form a groove or guide opening towards the respectively opposite projections.

Figure 2:
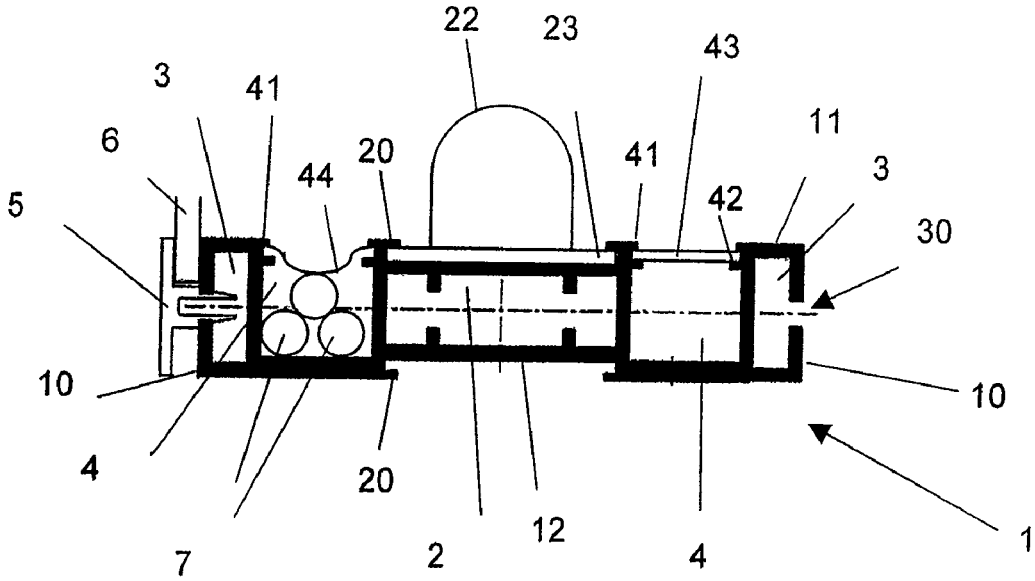
FIG. 2 shows a schematic sectional view of the profile shown in FIG. 1 with a luminaire inserted.

The profile 1 is formed on its cover face 11 and a bottom face 12 with undercuts 20, into which, for example, a light tube, illustrated in FIG. 2, can be inserted.

FIG. 2 shows, schematically, the profile 1 shown in FIG. 1, a luminaire 22 being inserted into undercuts 20 of the first hollow chamber 2. The luminaire 22 is formed with projections 23 for this purpose. Additionally or alternatively, the luminaire 22 can also be screwed and/or connected in another manner to a profile.

In the embodiment illustrated, the empty hollow chamber 4 is closed by a covering strip 43. For this purpose, the covering strip 43 engages between the projections 41, 42 of the hollow chamber 4. Cable clips 44 can engage behind at least one pair of projections 41, 42 of the hollow chamber 4, which are arranged on both sides of the cable groove 40 and into which cables 7 are inserted. In the embodiment illustrated, cable clips 44 engage behind the outer projections 41 of the hollow chamber 4. In addition, it is possible for the cable clips 44 to engage behind the inner pair of projections 42, with the result that, in addition, a covering strip 43 can be inserted between the projections 41, 42. Other possible cable fixings are described further below with reference to FIGS. 14-16.

Figure 3:
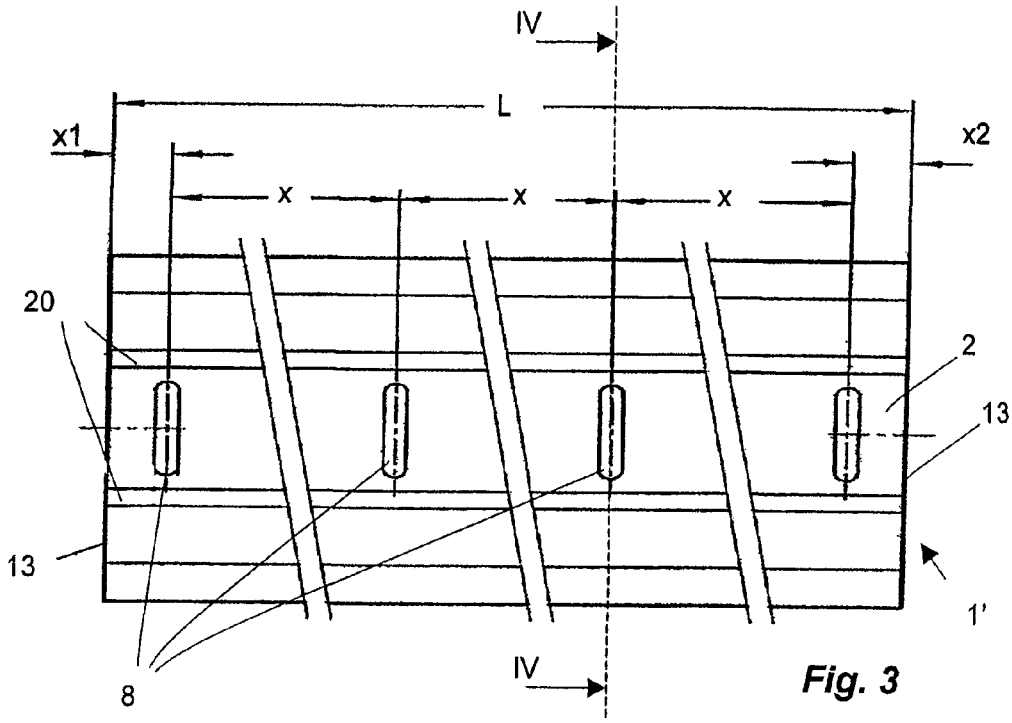
FIG. 3 shows a plan view of a profile shown in FIG. 1 with cutouts incorporated.
Figure 4:
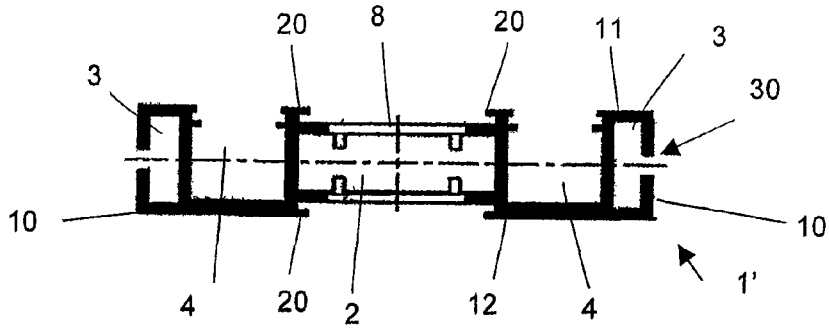
FIG. 4 shows a sectional view of the profile shown in FIG. 3 on a section plane IV-IV in FIG. 3.
Figure 5:
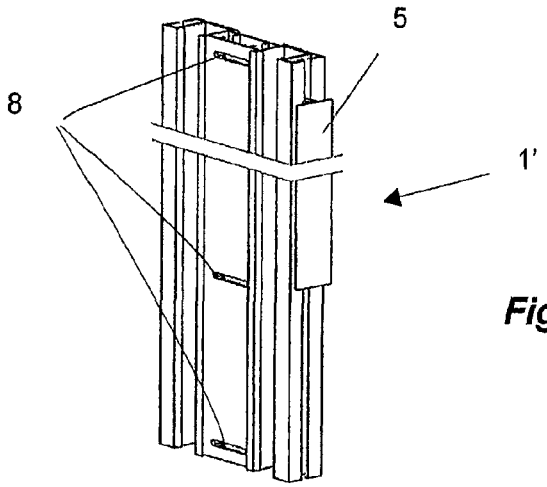
FIG. 5 shows a perspective illustration of the profile shown in FIG. 3.

FIGS. 3 to 5 show an embodiment of a profile 1', in contrast to the profile 1 in FIG. 1 cutouts 8 being incorporated into the cover face 11 and the bottom face 12 in the region of the central hollow chamber 2. In this case, FIG. 3 shows a plan view of the profile 1', FIG. 4 shows a sectional view of the profile 1' on a section plane IV-IV in FIG. 3, and FIG. 5 shows a perspective illustration of the profile 1'.

The profile 1' has a length L. The cutouts 8 are arranged at a distance x1, x2 from end faces 13 of the profile 1' and spaced apart from one another by a distance x. In the embodiment illustrated, the distances x1, x2 from the end faces 13 are equal. However, embodiments are also contemplated in which the distances x1, x2 from the end faces 13 are selected to be different. In addition, embodiments are contemplated in which the cutouts are spaced apart at varying distances x, depending on the intended configuration for a trellis of a light wall to be constructed.

FIG. 5 is a perspective illustration of the profile 1' with a strip 5 inserted for fixing the transparent plates 6 illustrated in FIGS. 1 and 2. As can be seen in FIG. 5, the strip 5 extends along the system groove 30.

Expanding hooks of turnbuckles 9 (illustrated in FIGS. 6-9) can be inserted into the cutouts 8 of the profile 1', with the result that a further profile can be connected to the profile 1' using the cutouts 8. The connection preferably takes place at right angles.

Figure 6:
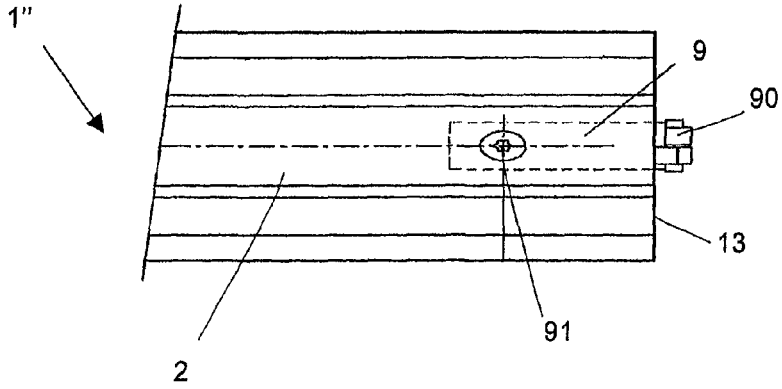
FIG. 6 shows a plan view of a profile shown in FIG. 1 with a turnbuckle inserted.
Figure 7:
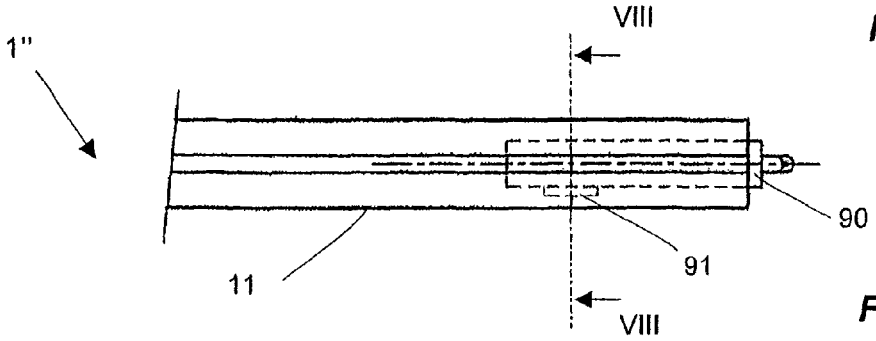
FIG. 7 shows a side view of the profile shown in FIG. 6.
Figure 8:
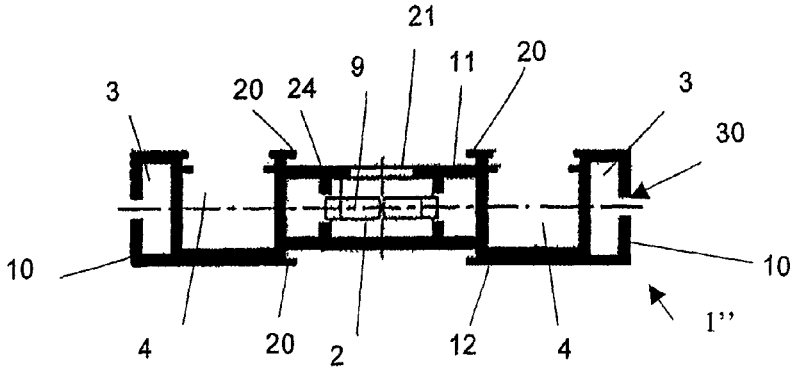
FIG. 8 shows a sectional view of the profile shown in FIG. 6 on a section plane VIII-VIII in FIG. 7.
Figure 9:
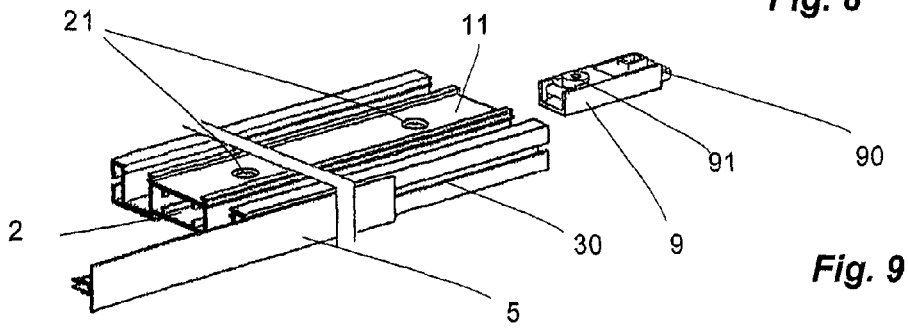
FIG. 9 shows a perspective illustration of the profile shown in FIG. 6.

FIGS. 6 to 9 show a further embodiment of a profile 1", a turnbuckle 9 being inserted into the hollow chamber 2 on an end face 13. In this case, FIG. 6 shows a plan view of the profile 1", FIG. 7 shows a side view of the profile 1", FIG. 8 shows a sectional view of the profile 1" on a section plane VIII-VIII in FIG. 7, and FIG. 9 shows a perspective illustration of the profile 1".

The turnbuckle 9 includes expanding hooks 90, which are capable of spreading apart from one another by way of an eccentric screw 91, with the result that the expanding hooks 90 can engage behind a system groove 30 or a cutout 8 for a fixed connection. In the embodiment illustrated, the profile 1" is provided with a drilled hole 21 in the cover face 11 in the region of the hollow chamber 2, via which drilled hole 21 the eccentric screw 91 is accessible. In the same way, the drilled hole 21 can be arranged in the region of the bottom face 12.

In the embodiment illustrated, the turnbuckle 9 is held in the hollow chamber 2 in the transverse direction by guides 24. Instead of a turnbuckle 9, standing feet, miter brackets or similar elements can also be inserted into the hollow chamber 2.

Figure 10:
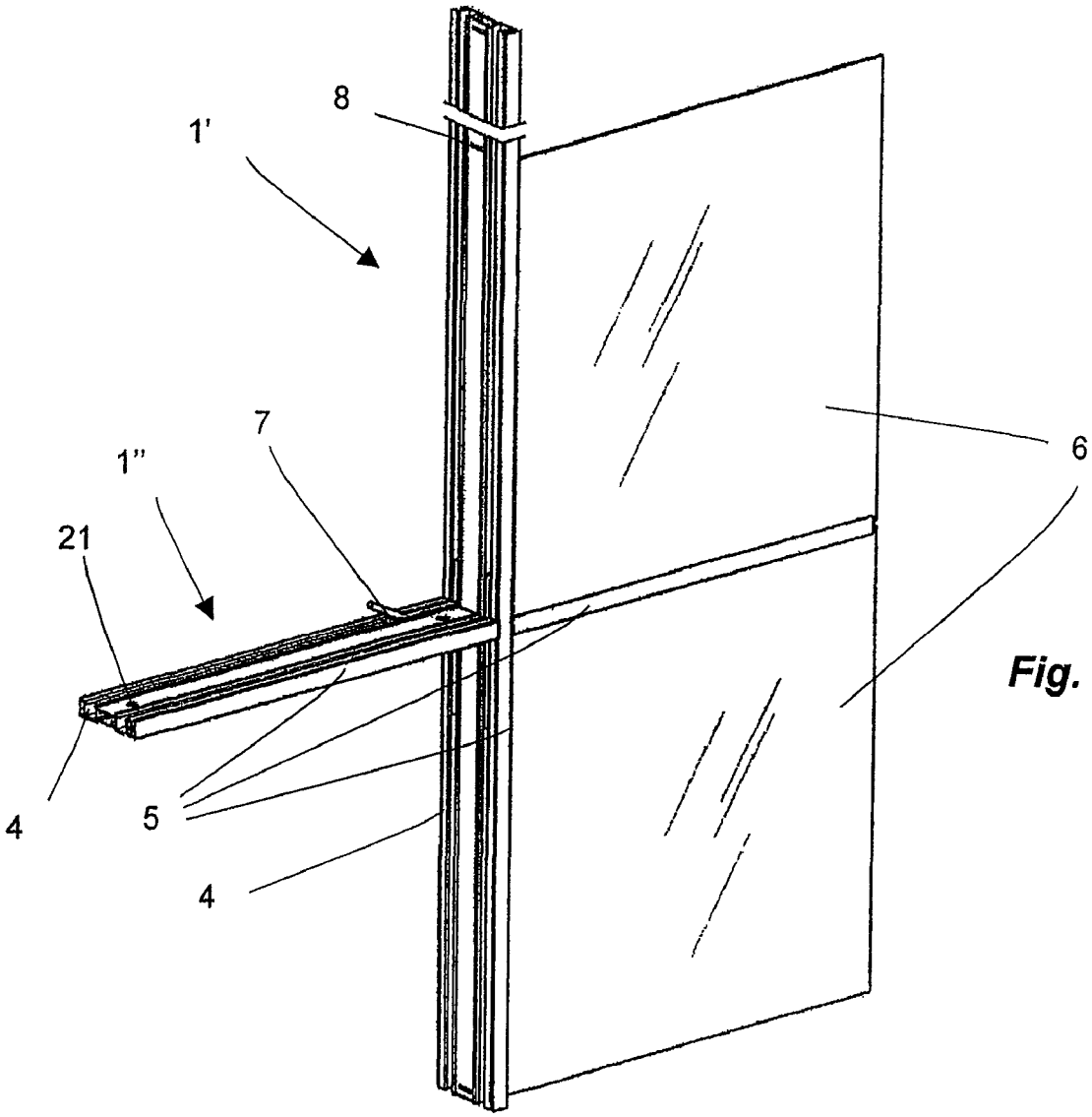
FIG. 10 shows a detail of a light wall according to the invention.

FIG. 10 shows, schematically, a detail of a light wall according to the invention including a profile 1' as shown in FIGS. 3 to 5, two profiles 1" as shown in FIGS. 6 to 9 being inserted into cutouts 8 on the profile 1' and each being connected fixedly to the profile 1' via a turnbuckle 9 (not shown). The profiles 1', 1" have the same cross-sectional shape, and they differ only in terms of the incorporated cutouts 8 and drilled holes 21 in the embodiment illustrated. The coupling of the profile 1" to the profile 1' takes place such that the lateral outer faces 10 of the profiles and the system grooves 30 for the strips 5 lie in one plane. The transparent plates 6 are therefore capable of being fixed easily to the lateral outer faces 10 of the profiles by the T-shaped strips 5. In this case, the strips 5 can preferably be inserted into the system grooves 30 of the profiles 1', 1" without the use of a tool. The cable grooves 40 likewise lie in one plane. In the embodiment illustrated, the profiles 1', 1" are arranged such that the cable grooves 40 of the profiles 1" are at the top and the cable grooves 40 of the profiles 1' are aligned towards the left in the drawing. The cable 7 can be fixed by use of cable clips illustrated schematically in FIG. 2. It is therefore also possible to fix the profile 1" to the profile 1' in a position which is pivoted through 180° about the longitudinal axis.

A turnbuckle for a connection to a further profile 1' can likewise be inserted into that free end of the profile 1" which can be seen in the drawing.

The profiles 1' and 1" are parts of a light wall profile system, the profiles 1' and 1" having the same cross-sectional shape and each being capable of being used as a support or as a frame. The length of the profiles 1', 1" may be as desired, the distance x between two cutouts 8 of the profile 1' and the length of the profile 1" preferably being selected such that essentially square plates 6 can be inserted.

Figure 11:
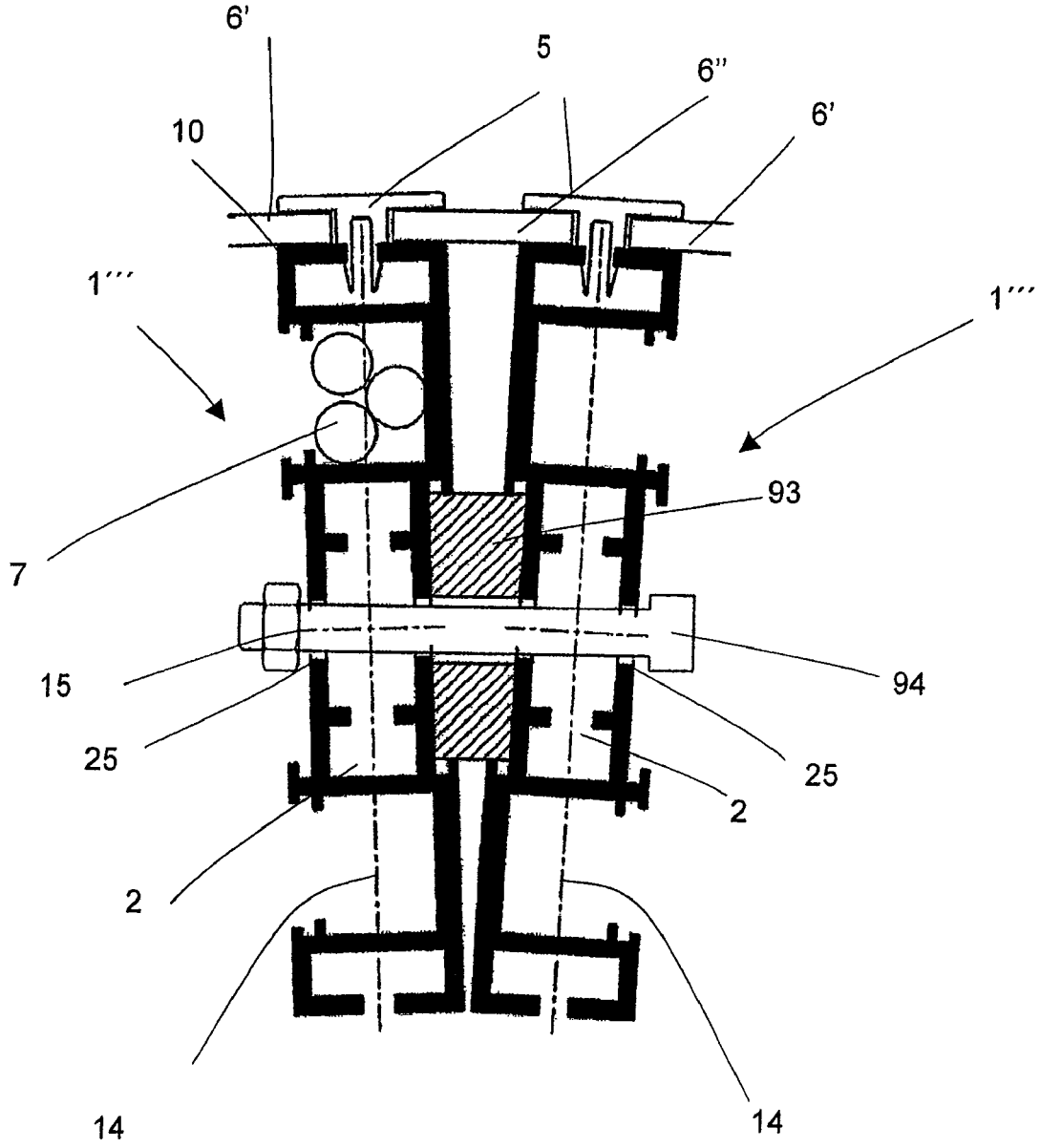
FIG. 11 shows two profiles, which are connected to one another for a light wall having a round shape.

FIG. 11 shows another arrangement of two profiles 1''' of a light wall profile system. The longitudinal axes of the profiles 1''' run parallel to one another, the profiles 1''' being connected by means of a wedge-shaped coupling element 93 and a connecting screw 94 such that the transverse axes 14, 15 form an angle. A light wall having a round shape can therefore be constructed using the profiles 1''' and the coupling elements 93. In this embodiment, wall elements 6', 6" having different sizes are fitted to the outer faces 10 via T-shaped strips 5. As can be seen, the wedge-shaped coupling elements 93 may also have a larger opening angle in order to realize different light wall radii.

The profiles 1''' have the same cross-sectional shape as the profile 1, already described, a drilled through-hole 25 for accommodating the connecting screw 94 being incorporated in the region of the hollow chamber 2. Connectors, feet, terminal elements or the like can be inserted into the end faces of the profiles 1'''.

Figure 12:
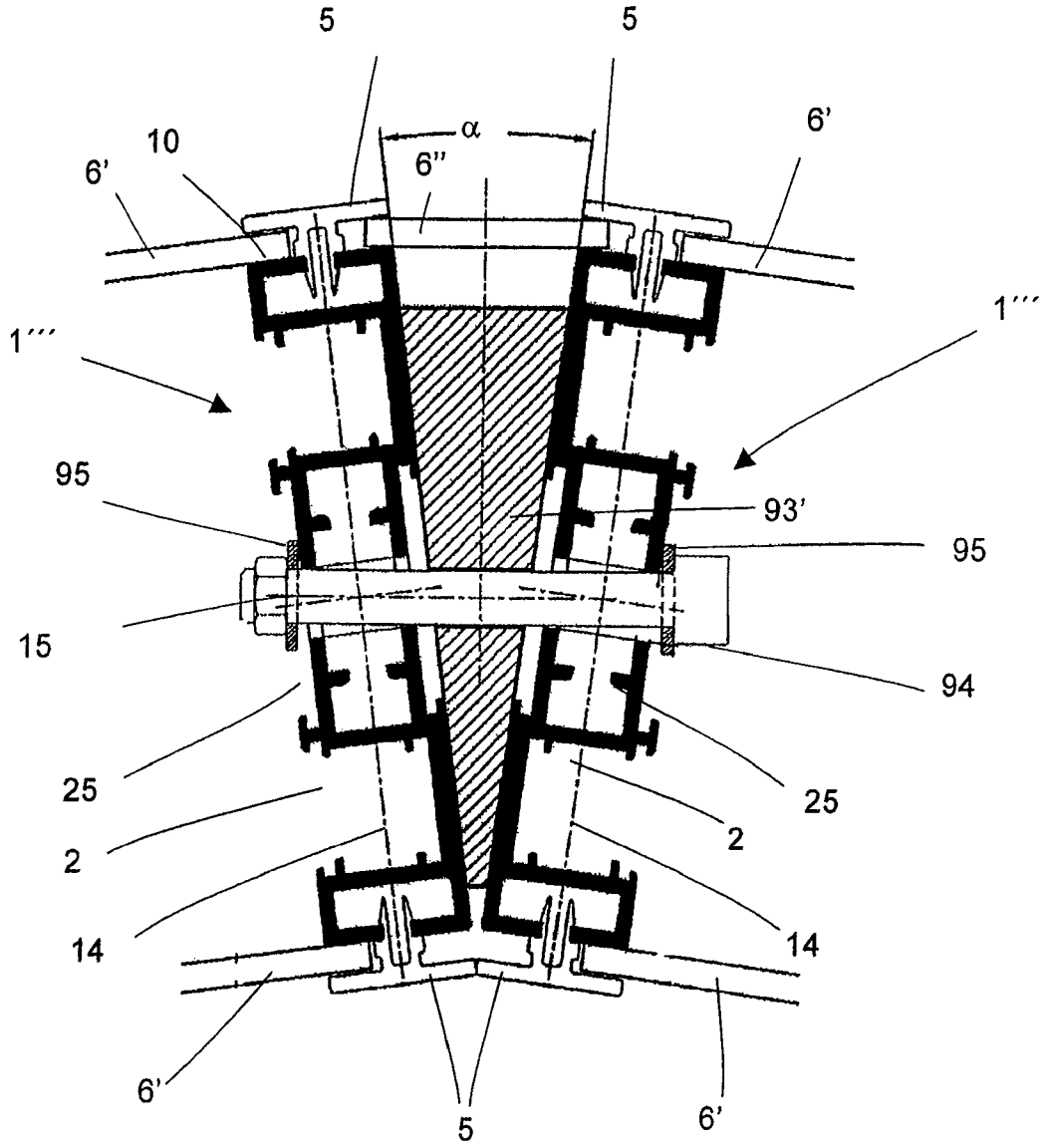
FIG. 12 shows a second embodiment of a connection of two profiles for a light wall having a round shape.

FIG. 12 shows a further arrangement of two profiles 1''' of a light wall profile system for a round wall. The longitudinal axes of the profiles 1''' likewise run parallel to one another, the profiles 1''' being connected by use of a wedge-shaped (in cross section), tapering coupling element 93' with an angle $\alpha$, a connecting screw 94 and insert disks 95, such that the transverse axes 14, 15 form an angle. In the embodiment illustrated, the angle $\alpha$ is approximately 15°. As can be seen, the wedge-shaped coupling element 93' may, however, also have a larger or a smaller opening angle in order to realize different light wall radii. The insert disks, 95 improve a connection via the connecting screw 94, but are not necessary when using the coupling elements 93'. It is likewise apparent that, even in the connection shown in FIG. 11, insert disks 95 may be provided.

As in the embodiment shown in FIG. 11, wall elements 6', 6" are fitted to the outer faces 10 via T-shaped strips 5. Depending on the embodiment of the round wall to be constructed, as illustrated in FIG. 12, wall elements 6' are provided both on the outer faces 10 of the hollow chambers 3 forming an inner wall and on the outer faces 10 of the hollow chambers 3 forming an outer wall or, as illustrated in FIG. 11, only on the outer faces 10 of the hollow chambers 3, which form an outer wall, of a round wall to be constructed.

The profiles 1', 1" and 1''' can be connected to one another as desired. By introducing the corresponding cutouts or drilled holes, the profiles can each be produced from the basic profile illustrated in FIG. 1. It is also contemplated to form both cutouts and drilled holes on a profile. In addition, it is possible to incorporate universal cutouts into the cover face and/or the bottom face of the profile, into which universal cutouts both the expanding hooks of a turnbuckle 9 and the bolts 94 can be inserted.

Figure 13:
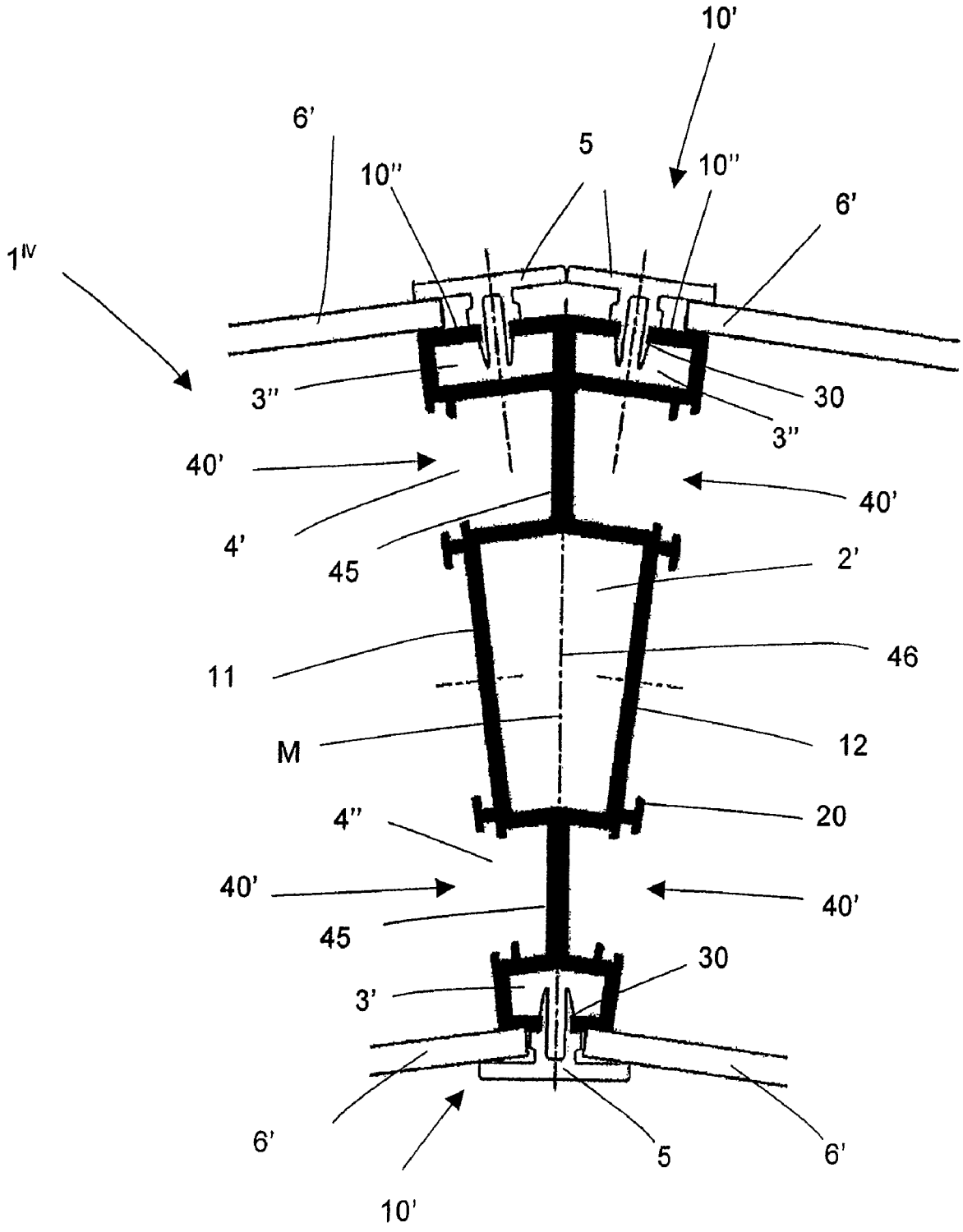
FIG. 13 shows an alternative embodiment of a profile for a light wall having a round shape.

FIG. 13 shows an alternative embodiment of a profile $\mathbf{1}^{IV}$ for a round wall. In this embodiment, the cover face 11 and the bottom face 12 form an angle, with the result that the outer sides 10' of the profile $\mathbf{1}^{IV}$ have different widths and, overall, a trapezoidal cross-sectional shape of the profile $\mathbf{1}^{IV}$ results. The profile $\mathbf{1}^{IV}$ has a central hollow chamber 2' and three outer hollow chambers 3', 3", a hollow chamber 3' being arranged on the narrower outer side 10', and two hollow chambers 3" being arranged on the wider outer side 10', and the outer faces 10" of the hollow chambers 3" likewise forming an angle. The hollow chambers 3', 3" are provided in each case with a system groove 30 on their outer faces 10". The already described, T-shaped (in cross section) strips 5 for fixing plates 6' or other wall elements can be inserted into the system grooves 30 of the hollow chambers 3', 3".

The hollow chambers 4', 4" each have a web 45, which lies in a central plane M and divides the hollow chambers 4', 4" such that, in each of the two hollow chambers 4', 4", in each case one cable groove 40' opens on the cover face 11 and on the bottom face 12. The profile $\mathbf{1}^{IV}$ is therefore symmetrical with respect to the central plane M.

Figure 14:
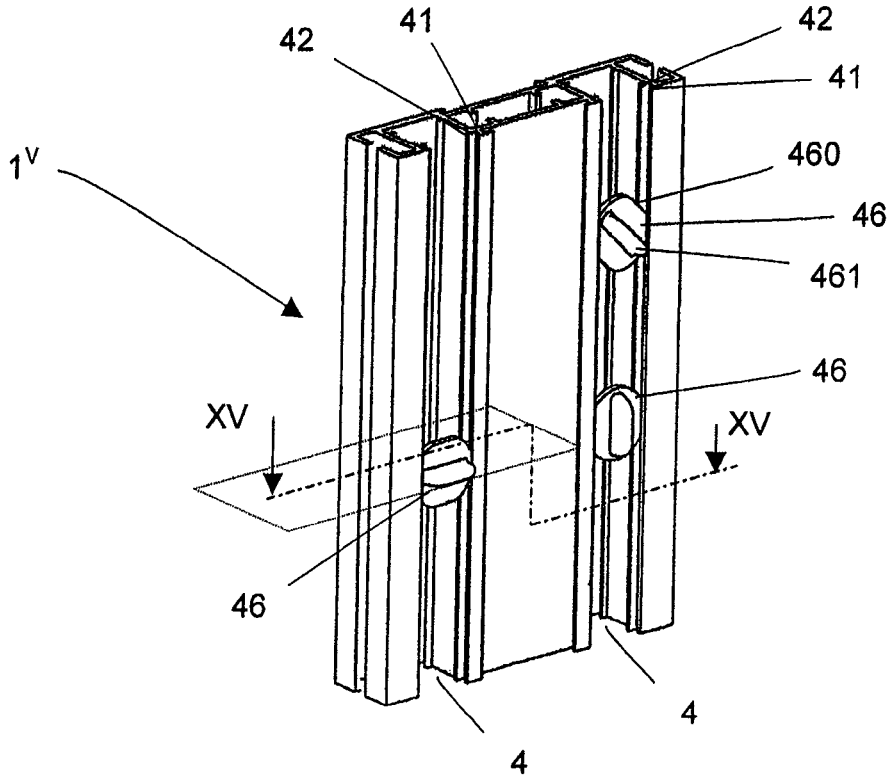
FIG. 14 shows a perspective illustration of a profile with cable fixings inserted.
Figure 15:
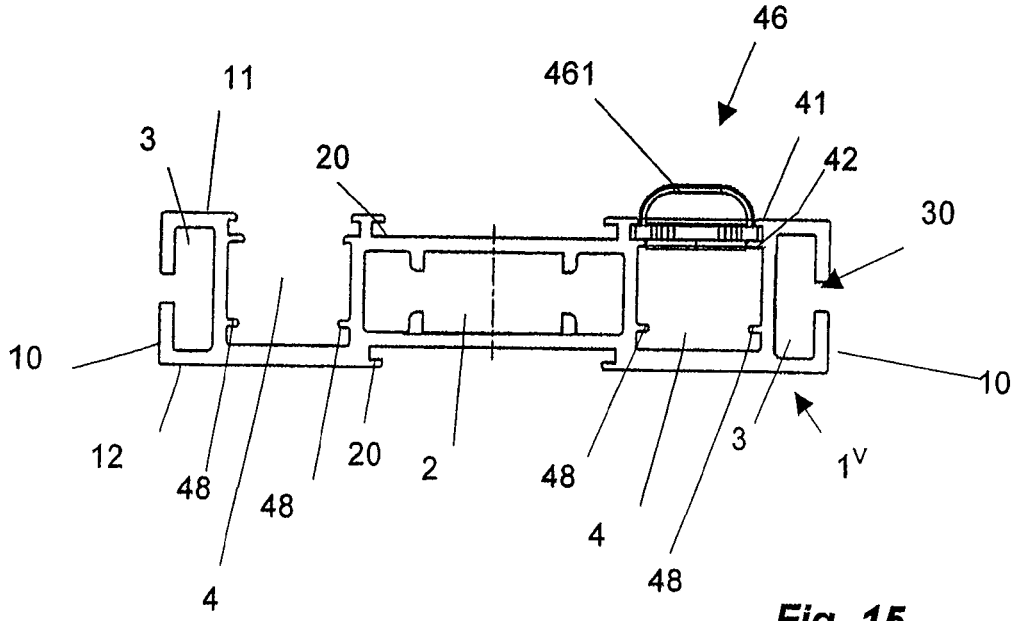
FIG. 15 shows a sectional view of the profile shown in FIG. 14 on a section plane XV-XV in FIG. 14.

FIGS. 14-16 show two embodiments of possible cable fixings 46, 47, which are each clamped in between the projections 41, 42 of the hollow chambers 4 with the cable groove 40.

FIGS. 14 and 15 show a profile $\mathbf{1}^{V}$ and a first embodiment of a cable fixing 46, which is essentially in the form of a circle with two flattened edges 460. In this case, FIG. 14 shows a perspective illustration of the profile $\mathbf{1}^{V}$ with three inserted cable fixings 46, and FIG. 15 shows a sectional view of the profile $\mathbf{1}^{V}$ with one inserted cable fixing on the section plane XV-XV in FIG. 14. The cable fixing 46 has a handle 461 to make it easier to manipulate, which handle 461 runs essentially parallel to the flattened edges 460. When adjusting the handle 461 in the direction of the longitudinal axis of the profile 1 and therefore in the direction of the cable groove 40, the cable fixing 46 can be inserted into the cable groove 40 at the level of the projections 41, 42. By rotating the cable fixing 46, it engages between the projections 41, 42 and is thus fixed. In the embodiment illustrated, the projections 42 protrude further into the hollow chambers 4 than the projections 41. In this case, a cable fixing may be dimensioned such that its narrower extent, in the example illustrated the direction transverse with respect to the flattened edges 461, is smaller than the distance between the projection 41 and larger than the distance between the projections 42. Then, during the insertion, the cable fixing "can be laid" on the projections 42 and can be fixed between the projections 41, 42 by being rotated. As can be seen from a comparison of FIGS. 15 and 1, the profile $\mathbf{1}^{V}$ essentially corresponds to the profile 1, but it has additional projections 48, whose function will be explained further below, with reference to FIG. 19.

FIG. 16 shows the profile $\mathbf{1}^{V}$, into which a second embodiment of a cable fixing 47 is inserted. The cable fixing 47 is a spring which is bent essentially in the form of a Z and can be compressed by applying a force, with the result that it can be inserted into the cable groove 40 at the level of the projections 41, 42, it is relieved of strain when the force is removed and thus engages and is fixed between the projections 41, 42. The illustrated cable fixing 47 has two essentially parallel arms 471, of which in each case only one can be seen and which engage between the projections 41, 42 and are connected in the form of a Z via an obliquely running arm 472. In addition, two clamps 473 are arranged on the arms 471 in order to make it easier to manipulate the cable fixing 47, which clamps 473 are bent back towards the arms 471 at an angle of approximately 30°-80°.

As has already been described, feet can be inserted into the hollow chambers 2 of the profiles. FIGS. 17 and 18 show two possible foot receptacles for inserting feet into the profiles.

FIG. 17 shows a perspective, exploded illustration of the profile $\mathbf{1}^{V}$, a foot receptacle 51, which can be inserted into the hollow chamber 2, and a foot 52. The foot receptacle 51 has an essentially T-shaped cross section and can be inserted with a base body 510 into the hollow chamber 2 between the guides 24, with the result that a T bar 511 of the foot receptacles bears against the end face 13. The foot receptacle 51 is provided with an inner thread 512, into which a threaded shaft 520 of the foot 52 can be screwed. The foot 52 is provided with a standing area 521 at its ends opposite the threaded shaft 520.

FIG. 18 shows a perspective, exploded illustration of the profile $\mathbf{1}^{V}$, a second embodiment of a foot receptacle 51', which can be inserted into the hollow chamber 2, of the foot 52 and of the profile strip 5. The foot receptacle 51' has a base plate 513, on which pins 514 are fixed. The foot receptacle 51' also has cutouts 515 with internal threads, into which feet 52 can be screwed. In the embodiment illustrated, three cutouts 515 are formed on the base plate 513, two feet 52 being inserted into the outer cutouts 515. In addition, it is also contemplated to use three feet with correspondingly smaller standing areas 521. In another embodiment, a foot 52 is inserted into the central cutout 515.

In the embodiment illustrated, the pins 514 can be inserted into the system grooves 30 of the outer hollow chambers 3 and can be fixed there by means of threaded pins 516. As is illustrated, the profile strip 5 is preferably correspondingly notched at the point of the threaded pins 516.

It can be seen that the foot receptacles shown in FIGS. 17 and 18 can likewise be inserted into the profiles 1, 1'-1$^{IV}$.

Figure 19:
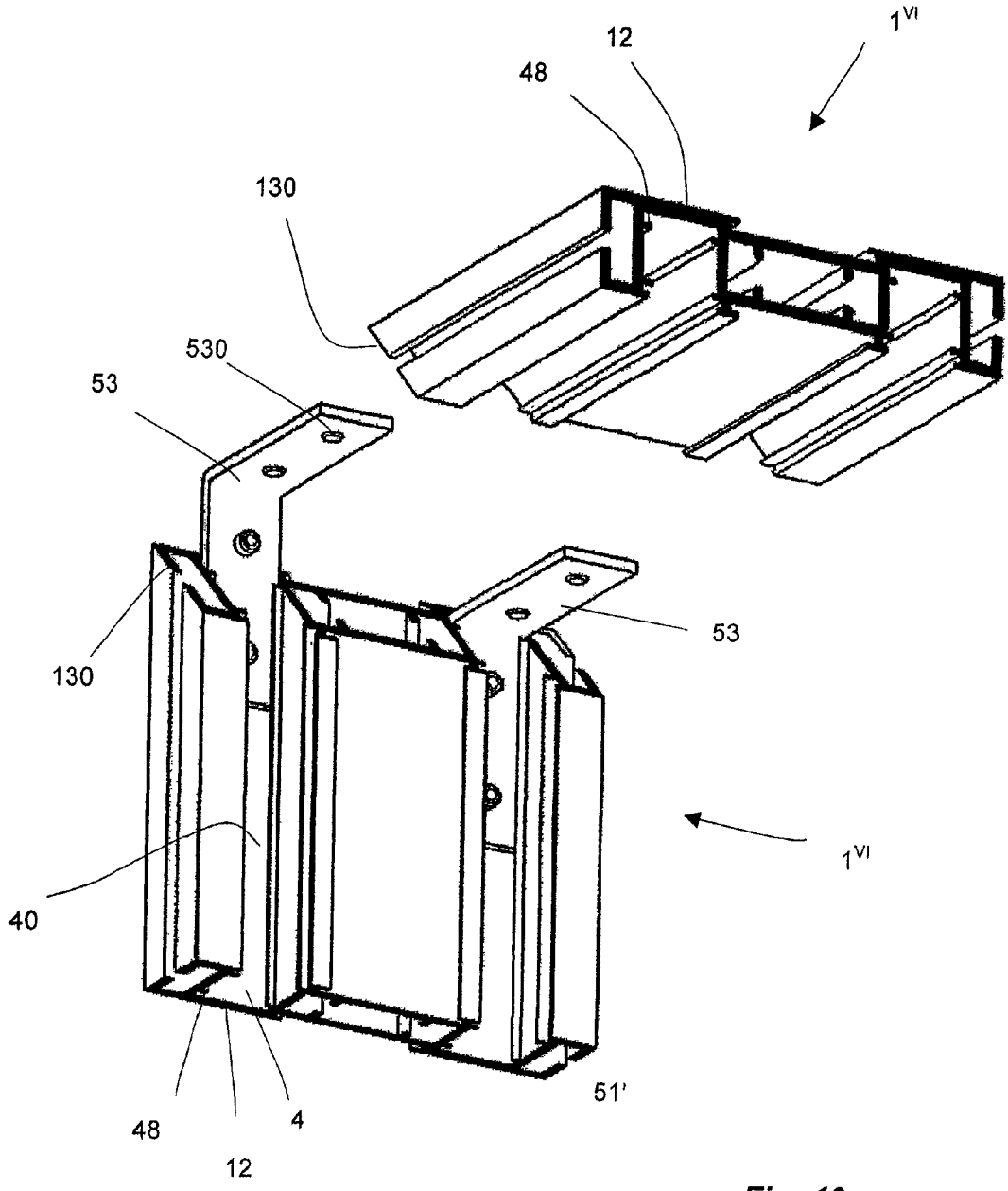
FIG. 19 shows a perspective, exploded illustration of two profiles, which are connected via miter brackets.

FIG. 19 shows an alternative possibility for connecting two profiles 1$^{VI}$ around a corner by means of miter brackets 53. The profiles 1$^{VI}$ illustrated essentially correspond to the profiles 1$^{V}$, but have mutually complementary, oblique end faces 130 in each case on one side, at which end faces 130 the two profiles 1$^{VI}$ adjoin one another. The miter brackets 53 can be inserted into the hollow chambers 4 between a bottom plate 12 and the projections 48 and can be connected to the profiles 1$^{VI}$, if necessary, by way of cutouts 530, for example by screwing and/or riveting. Alternatively, studs can be screwed into the cutouts 530 which clamp the miter bracket 53 against the profile sections and, as a result, fix them in relation to the profile sections.

Owing to the open cable groove 40, good access to the cutouts 530 is also possible once the profiles 1$^{VI}$ have been assembled.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A profile for a light wall, the profile having a cover face, a bottom face, outer faces and end sides, comprising:

at least one first, essentially closed hollow chamber, into which a connector can be inserted on at least one end side of the profile;

at least one second hollow chamber having a system groove running essentially parallel to a longitudinal axis on a lateral outer face, into which a holder for a wall element, arrangeable essentially parallel to a lateral outer face, is insertable; and at least one third hollow chamber with at least one cable groove, which runs essentially parallel to the longitudinal axis and opens toward at least one of the cover face and the bottom face of the profile, wherein the cable groove extends essentially over an entire height of the profile.

2. The profile for a light wall as claimed in claim 1, wherein the third hollow chamber is arranged between the first hollow chamber and the second hollow chamber.

3. The profile for a light wall as claimed in claim 1, wherein the profile is essentially symmetrical.

4. The profile for a light wall as claimed in claim 1, wherein the first hollow chamber is rectangular, and comprises edges running parallel to the cover face that are longer than edges running parallel to the outer faces.

5. The profile for a light wall as claimed in claim 1, wherein, in a region of the first hollow chamber, at least one cutout, which extends in substantially transversely with respect to the longitudinal axis of the profile, is incorporated into the at least one of the cover face and the bottom face.

6. The profile for a light wall as claimed in claim 1, further comprising one of a turnbuckle, a foot, and a miter bracket insertable into the first hollow chamber on at least one of the end sides of the profile.

7. The profile for a light wall as claimed in claim 1, wherein the at least one of the cover face and the bottom face of the first hollow chamber has at least one undercut, to which a luminaire is fixable.

8. The profile for a light wall as claimed in claim 1, wherein the cable groove has at least one projection extending into the groove opening transversely with respect to the longitudinal axis of the groove.

9. The profile for a light wall as claimed in claim 1, wherein the cable groove has at least two projections extending into the groove opening transversely with respect to the longitudinal axis of the groove.

10. The profile for a light wall as claimed in claim 8, wherein the cable groove has at least one further projection on both sides at a bottom of the groove.

11. The profile for a light wall as claimed in claim 1, wherein the at least one third hollow chamber has a web dividing the chamber, with a result that in each case one cable groove opens in the region of the third hollow chamber both towards the cover face and towards the bottom face.

12. The profile for a light wall as claimed in claim 2, wherein the at least one third hollow chamber has a web dividing the chamber, with a result that in each case one cable groove opens in the region of the third hollow chamber both towards the cover face and towards the bottom face.

13. The profile for a light wall as claimed in claim 1, wherein the cover face and the bottom face form an angle.

14. The profile for a light wall as claimed in claim 11, wherein the cover face and the bottom face form an angle.

15. The profile for a light wall as claimed in claim 13, wherein two hollow chambers with outer faces, which are arranged at an angle with respect to one another, each having an outer system groove, which runs essentially parallel to the longitudinal axis, are arranged on a broader outer side of the profile.

16. The profile for a light wall as claimed in claim 14, wherein two hollow chambers with outer faces, which are arranged at an angle with respect to one another, each having an outer system groove, which runs essentially parallel to the longitudinal axis, are arranged on a broader outer side of the profile.

17. A light wall profile system comprising at least two profiles as claimed in claim 1, wherein the two profiles are arrangeable in relation to one another as a support and frame and are coupleable by a connector, whereby the outer faces of the profiles lie in one plane.

18. A light wall profile system comprising at least two profiles as claimed in claim 11, wherein the two profiles are arrangeable in relation to one another as a support and frame and are coupleable by a connector, whereby the outer faces of the profiles lie in one plane.

19. The light wall profile system as claimed in claim 17, wherein a first of the two profiles has at least one cutout, which runs transversely with respect to the longitudinal axis, in the cover and/or bottom face, and the connector is inserted into at least one end face of a second profile, and the second profile is fixed to the cutout of the first profile by the connector.

20. A light wall profile system comprising at least two profiles as claimed in claim 1, wherein the two profiles, which are arranged parallel with respect to their longitudinal axis, are connected by at least one essentially wedge-shaped coupling element such that the transverse axes, which are parallel to the cover face, of the two profiles form an angle of between 0° and 90°.

* * * * *